US011274009B2

(12) United States Patent
Ishizuka et al.

(10) Patent No.: US 11,274,009 B2
(45) Date of Patent: Mar. 15, 2022

(54) STACKER DEVICE AND IMAGE FORMING SYSTEM

(71) Applicant: Konica Minolta Inc., Tokyo (JP)

(72) Inventors: Tatsuo Ishizuka, Hino (JP); Akira Okamoto, Hino (JP); Teruhiko Toyoizumi, Tachikawa (JP)

(73) Assignee: KONICA MINOLTA, INC., Tokyo (JP)

( * ) Notice: Subject to any disclaimer, the term of this patent is extended or adjusted under 35 U.S.C. 154(b) by 45 days.

(21) Appl. No.: 16/595,719

(22) Filed: Oct. 8, 2019

(65) Prior Publication Data

US 2020/0122945 A1 Apr. 23, 2020

(30) Foreign Application Priority Data

Oct. 22, 2018 (JP) ..... JP2018-198219

(51) Int. Cl.
*B65H 31/32* (2006.01)
*B65H 43/00* (2006.01)
*B65H 31/10* (2006.01)

(52) U.S. Cl.
CPC ..... *B65H 31/32* (2013.01); *B65H 31/10* (2013.01); *B65H 43/00* (2013.01); *B65H 2301/42252* (2013.01); *B65H 2301/42256* (2013.01); *B65H 2402/443* (2013.01); *B65H 2402/45* (2013.01); *B65H 2405/15* (2013.01); *B65H 2407/10* (2013.01); *B65H 2801/06* (2013.01)

(58) Field of Classification Search
CPC ..... B65H 2402/45; B65H 31/10; B65H 2407/10; B65H 31/32; B65H 2801/06; B65H 2301/42256; B65H 2402/443; B65H 2301/42252
See application file for complete search history.

(56) References Cited

U.S. PATENT DOCUMENTS 7,971,875 B2 * 7/2011 Iino ..... B62B 3/04 271/213
8,297,615 B2 * 10/2012 Nakamura ..... G03G 15/6573 271/214
8,794,622 B2 * 8/2014 Obuchi ..... B65H 31/18 271/214
8,944,430 B2 * 2/2015 Foerch ..... B65H 33/04 271/207
2009/0134572 A1 5/2009 Obuchi et al.

FOREIGN PATENT DOCUMENTS

JP 2002087693 A 3/2002

OTHER PUBLICATIONS

CNIPA First Office Action for corresponding CN Application No. 201910987577.9; dated Dec. 18, 2020.
CNIPA Office Action for corresponding CN Application No. 201910987577.9; dated Aug. 2, 2021.

* cited by examiner

*Primary Examiner* — Jeremy R Severson
(74) *Attorney, Agent, or Firm* — Cantor Colburn LLP

(57) ABSTRACT

A stacker device includes: a discharger that discharges sheets in response to a print job; a first tray on which the discharged sheets are stacked; a second tray that serves as a delivery destination of the sheets stacked on the first tray; a shutter that covers an opening on a front side of a housing; a driver that moves the first tray in an up-down direction; and a hardware processor that shuts off power to the driver based on a height position of the shutter and a position of the second tray in a front-rear direction.

8 Claims, 15 Drawing Sheets

STACKER DEVICE AND IMAGE FORMING SYSTEM

The present invention claims priority under 35 U.S.C. § 119 to Japanese patent Application No. 2018-198219, filed on Oct. 22, 2018, the entire content of which is incorporated herein by reference.

BACKGROUND

Technological Field

The present invention relates to a stacker device and an image forming system.

Description of the Related Art

Stacker devices that stack sheets on which image forming apparatuses, such as a printer and a copier, form images are known. Such a stacker device is required to handle high-speed processing for image forming processing of an image forming apparatus and to have productivity in a sheet stacking operation such that the stacking amount per unit time is to be a predetermined amount or more. In addition, the stacker device performs a sheet discharging operation of discharging stacked sheets outside the stacker device. During the discharging operation, since the shutter of the stacker device is opened, and the inside of the device is temporarily released, which makes it possible to put a hand or a finger inside the stacker device. In order to avoid an accident of catching a hand or a finger in the tray on which sheets are stacked, such a stacker device is required to have the safety such that power supply to drive parts is shut off to suspend the stacking operation when the shutter is opened.

However, since a suspension period in a stacking operation of a stacker device is also a downtime of an image forming apparatus, and if the suspension period of the stacking operation is prolonged or occurs frequently, the sheet productivity is lowered.

JP 2002-87693 A (claim 1 and Paragraph 0013) discloses "a safety mechanism device for sheet post-processing in which sheets discharged from an image forming means are stapled or not stapled and discharged on a discharge tray, the safety mechanism device including a mounting table on which the sheets before the stapling are temporarily stacked, a shutter means for securing safety in the stapling by covering a stapling area while the mounting table is being moved in an up-down direction with a predetermined space from above the mounting table, a switching means for performing switching processing to suspend the stapling by turning ON and OFF, and an amplification means for promoting suspension of the stapling by turning OFF the switching means when the shutter means moves upward such that a space is larger than the predetermined space and for amplifying a second moving stroke in a moving direction toward a connection point of the switching means based on a first moving stroke in the up-down direction in which the shutter means moves from the position of the predetermined space on the mounting table", in order to provide "a safety mechanism device with high accuracy while malfunction of a switch is prevented" and the like.

However, JP 2002-87693 A (claim 1 and Paragraph 0013) neither discloses nor suggests a means for improving the productivity of the sheet post-processing.

SUMMARY

In view of the above circumstances, an object of the present invention is to, in a sheet stacking operation of a stacker device, improve the productivity while necessary safety is secured.

To achieve the abovementioned object, according to an aspect of the present invention, a stacker device reflecting one aspect of the present invention comprises: a discharger that discharges sheets in response to a print job; a first tray on which the discharged sheets are stacked; a second tray that serves as a delivery destination of the sheets stacked on the first tray; a shutter that covers an opening on a front side of a housing; a driver that moves the first tray in an up-down direction; and a hardware processor that shuts off power to the driver based on a height position of the shutter and a position of the second tray in a front-rear direction.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 4A is a left side view of the stacker device, and FIG. 4B is a diagram of a power shutoff circuit;

FIG. 5A is a left side view of the stacker device, FIG. 5B is a diagram of the power shutoff circuit, and FIG. 5C is a diagram for explaining taking the second tray base in and out;

FIG. 6A is a left side view of the stacker device, and FIG. 6B is a diagram of a power shutoff circuit;

FIG. 7A is a left side view of the stacker device, and FIG. 7B is a diagram of the power shutoff circuit;

FIG. 8A is a left side view of the stacker device, and FIG. 8B is a diagram of the power shutoff circuit;

DETAILED DESCRIPTION OF EMBODIMENTS

Hereinafter, one or more embodiments of the present invention will be described with reference to the drawings. However, the scope of the invention is not limited to the disclosed embodiments. For convenience of explanation, the direction in which the sheets stacked in a stacker device are taken out of the stacker device is referred to as a "front" or a "front side".

Figure 1B:
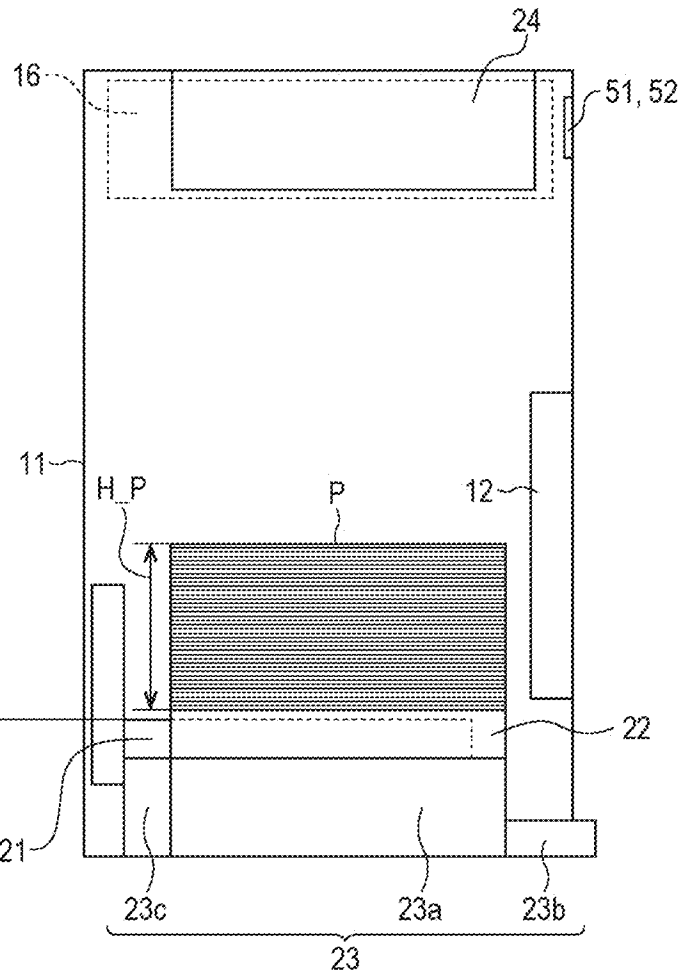
FIG. 1A and FIG. 1B are left side views of a stacker device according to the present embodiment.
Figure 1A:
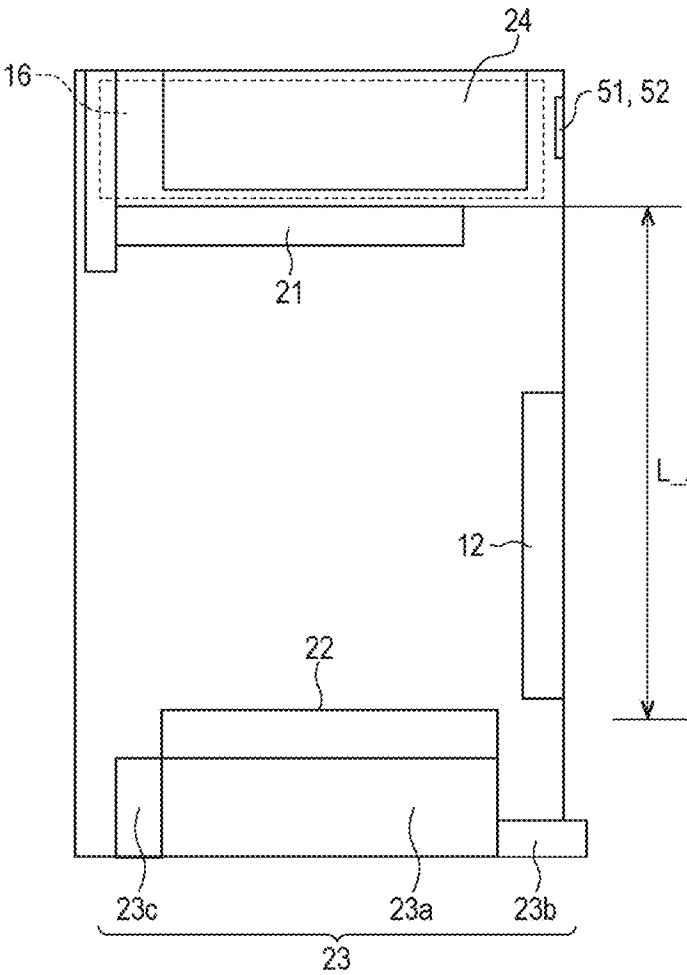

FIG. 1A and FIG. 1B are left side views of a stacker device 1 according to the present embodiment. The stacker device 1 includes a discharger 16, a first tray 21, a second tray 22, a second tray base 23, and a sub tray 24.

The discharger 16 discharges sheets P on which images are formed in response to a print job to a discharge destination. The discharge destination of the sheets P by the discharger 16 is either the first tray 21 or the sub tray 24.

The sheets P discharged by the discharger 16 are staked on the first tray 21 as the discharge destination.

The second tray 22 is a delivery destination of the sheets P stacked on the first tray 21, and can execute automatic outside-discharging processing for discharging the sheets P outside the stacker device 1. The automatic outside-discharging processing is executed to discharge the sheets P when the sheets P stacked on the first tray 21 reach a predetermined amount.

The second tray base 23 serves as a base for placing the second tray 22 thereon. The second tray base 23 is formed by a base portion 23*a*, a handle portion 23*b*, and a rear end 23*c*. The base portion 23*a* is used to place and receive the second tray 22 thereon. The handle portion 23*b* constitutes a front end of the second tray base 23, and is used to pull the second tray base 23 out of the stacker device 1. The rear end 23*c* is positioned at the rear end of the second tray base 23, and can prevent the entire second tray base 23 from separating from the stacker device 1 by being engaged with the front lower edge of a housing 11 of the stacker device 1.

The second tray base 23 is movable in the front-rear direction, and the second tray 22 is detachably placed on the second tray base 23 that is movable in the front-rear direction.

The sub tray 24 is used to stack the sheets P discharged by the discharger 16 thereon when an operation of delivering the sheets P stacked on the first tray 21 to the second tray 22 is executed. The sub tray 24 is provided above the first tray 21 and at the upper part of the housing 11. Stacking the sheets P on the sub tray 24 is preferably executed in case of an emergency, for example, when it is desired to continue discharging the sheets P by the discharger 16 although an operation of stacking the sheets P on the first tray 21 can not be performed due to some problems. Thus, normally, the operation of stacking the sheets P on the first tray 21 is executed. The sheets P stacked on the sub tray 24 can be transferred to the first tray 21 by, for example, the manual operation of a user, and the stacking operation on the first tray 21 can be continued.

The first tray 21 is provided above the second tray 22, and lowers toward the second tray 22 when an operation of delivering the sheets P stacked on the first tray 21 to the second tray 22 is executed.

Note that, a notification unit 51 and a setting unit 52 are provided on the side face of the housing 11. The notification unit 51 is formed by, for example, a liquid crystal display, and notifies a user of a procedure for operating the second tray 22. The setting unit 52 receives the setting content indicating whether the automatic outside-discharging processing executable by the second tray 22 is executed.

FIG. 1A shows, as an example, that a sheet reception start position is set to the uppermost position in the movement range of the first tray 21 and to the uppermost face of the first tray 21, and no sheets P are stacked on any of the first tray 21 and the sub tray 24 and are delivered to the second tray 22. Note that, the sheet reception start position is a position to start receiving the sheets P discharged by the discharger 16. FIG. 1B shows, as an example, that the first tray 21 is positioned at a sheet delivery position to the second tray 22, and the first tray 21 on which the sheets P are stacked is lowered to the second tray 22. Thus, a distance L_A indicates the distance from the sheet reception start position to the sheet delivery position. In FIG. 1B, a stacking height H_P at which the sheets P are stacked on the first tray 21 is determined based on the limit number of stacked sheets and the sheet thickness.

The amount of stacked sheets P corresponding to the limit number of stacked sheets is set to be smaller than the distance L_A. However, when, for example, a print job with which the limit number of stacked sheets is exceeded is set, that is, when the stacking height H_P exceeds the amount of stacked sheets P corresponding to the limit number of stacked sheets, a control of discharging a bundle of sheets P outside the stacker device 1 is executed in the middle of the print job.

The first tray 21 and the second tray 22 each are formed to have, for example, a comb shape. With this shape, when the first tray 21 is lowered, the bundle of sheets P stacked on the first tray 21 can be directly delivered to the second tray 22.

Figure 2:
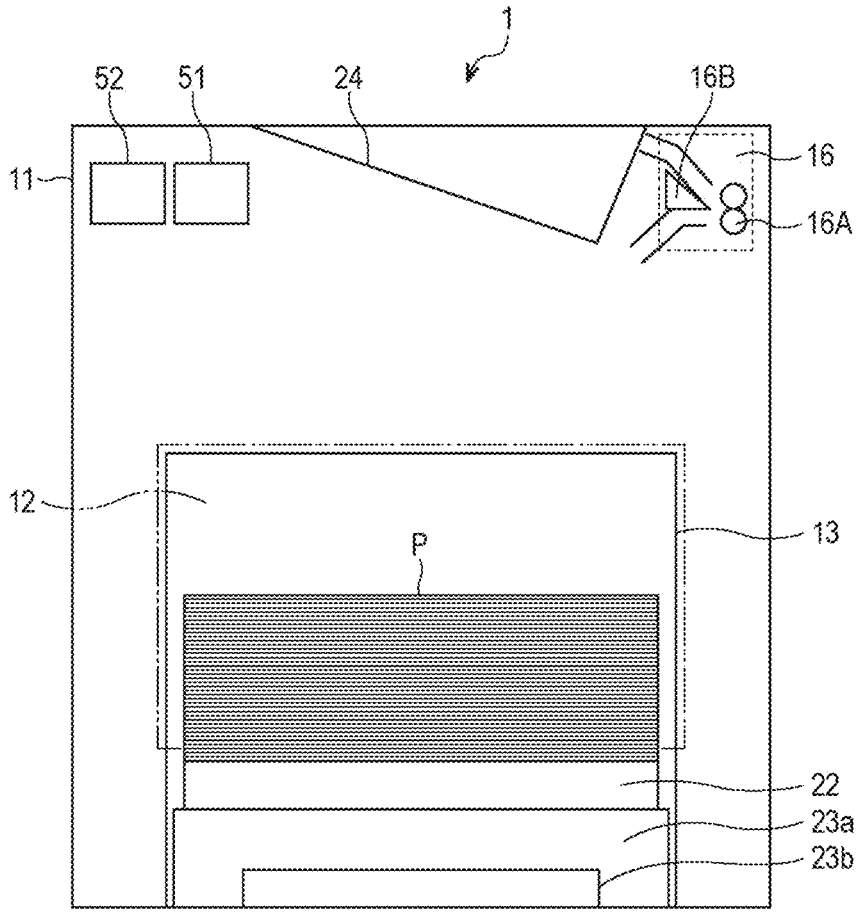
FIG. 2 is a front view of the stacker device according to the present embodiment.

FIG. 2 is a front view of the stacker device 1 according to the present embodiment. As shown in FIG. 2, the discharger 16 includes a discharging roller 16A and a switching part 16B. The discharging roller 16A discharges the sheets P. The switching part 16B is provided at the rear stage of the discharging roller 16A, and switches the discharge destination of the sheets P to be discharged by the discharging roller 16A.

The stacker device 1 includes a shutter 12 that covers an opening 13 on the front side of the housing 11. Since the shutter 12 is opened to move the second tray 22 outside the stacker device 1 from the opening 13 provided on the front side of the housing 11, it is possible to discharge the bundle of sheets P delivered to the second tray 22 outside the stacker device 1. Specifically, when the shutter 12 is opened, the second tray base 23 discharges the sheets P temporarily placed on the second tray 22 together with the second tray 22 outside the stacker device 1.

Figure 3:
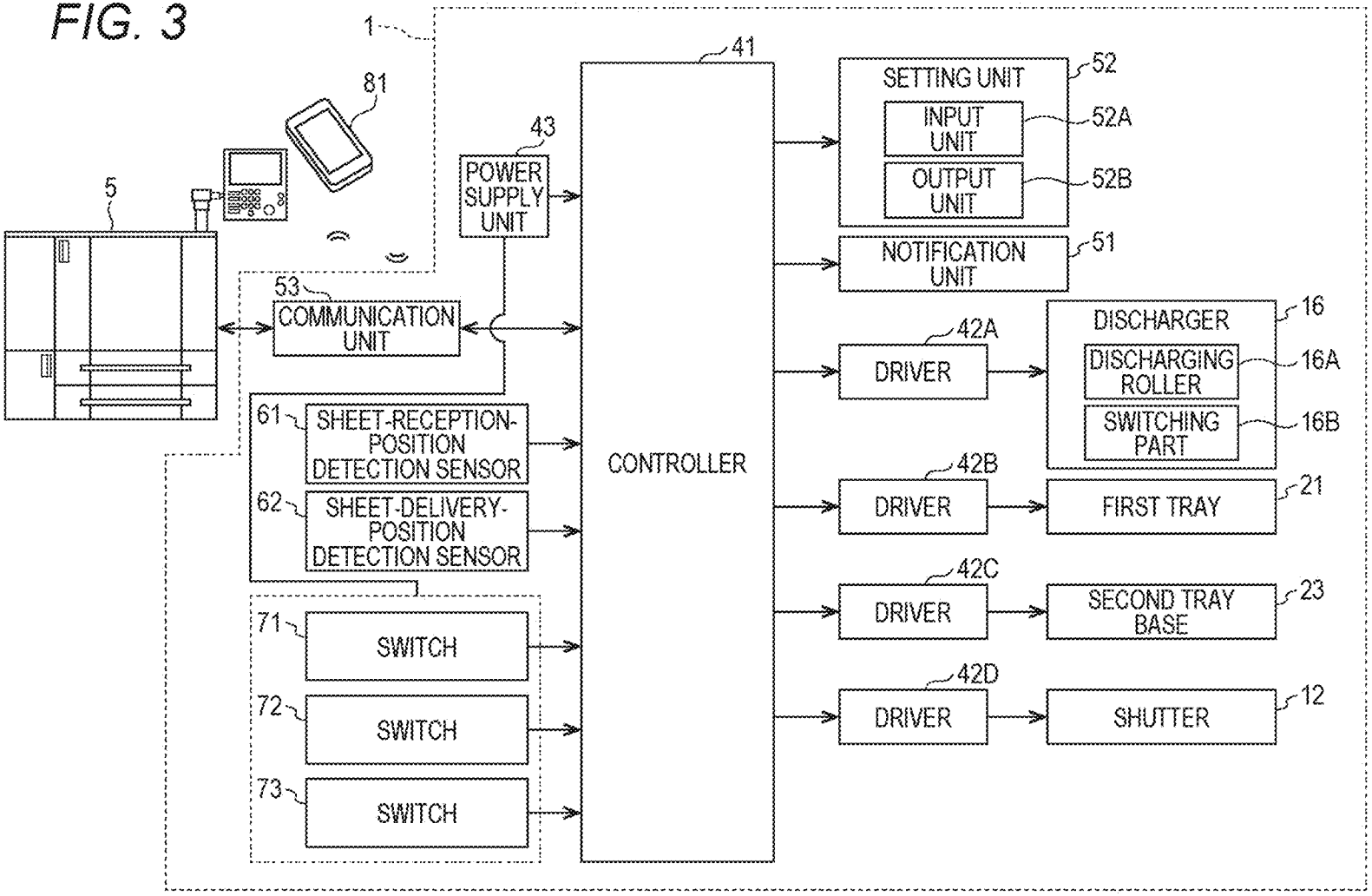
FIG. 3 is a block diagram showing a functional configuration of the stacker device according to the present embodiment.

FIG. 3 is a block diagram showing a functional configuration of the stacker device 1 according to the present embodiment. The stacker device 1 includes a controller 41. The controller 41 can be formed by a central processing unit (CPU), an application specific integrated circuit (ASIC), a firmware, or the like and a memory, and can execute various controls.

The stacker device 1 includes a sheet-reception-position detection sensor 61, a sheet-delivery-position detection sensor 62, and switches 71 to 73.

The sheet-reception-position detection sensor 61 detects whether the first tray 21 is positioned at the sheet reception position. The sheet-reception-position detection sensor 61 can be formed by, for example, a contact displacement sensor, but is not limited thereto. One or more sheet-reception-position detection sensors 61 can be disposed, for example, around the sheet reception position.

The sheet-delivery-position detection sensor 62 detects whether the first tray 21 is positioned at the sheet delivery position. The sheet-delivery-position detection sensor 62 can be formed by, for example, a contact displacement sensor, but is not limited thereto. One or more sheet-delivery-position detection sensors 62 can be disposed, for example, around the sheet delivery position.

The switch 71 is a sensor that detects that the shutter 12 is half-opened as the opening/closing state of the shutter 12. The switch 71 can be formed by, for example, an interlock switch, but is not limited thereto. One or more contacts of the switch 71 formed by an interlock switch can be disposed, for example, around a movable position of the shutter 12 that moves in the up-down direction.

The switch 72 is a sensor that detects the position of the second tray base in the front-rear direction. The switch 72 can detect whether the second tray 22 is discharged outside the stacker device 1 or housed inside the stacker device 1. The switch 72 can be formed by, for example, an interlock switch, but is not limited thereto. One or more contacts of the switch 72 formed by an interlock switch can be disposed, for example, around a movable position of the second tray base that moves in the front-rear direction, and, in particular, on the rear face of the housing 11 facing the second tray base 23.

The switch 73 is a sensor that detects that the shutter 12 is fully closed as the opening/closing state of the shutter 12. The switch 71 can be formed by, for example, an interlock switch, but is not limited thereto. One or more contacts of the switch 71 formed by an interlock switch can be disposed, for example, around a movable position of the shutter 12 that moves in the up-down direction, and, in particular, on the upper face of the handle portion 23*b* of the second tray base 23.

The controller 41 controls a driver 42A formed by, for example, a drive motor. Specifically, the controller 41 controls, based on various controls by an apparatus or the like provided at the front stage of the stacker device 1, the discharger 16 with the driver 42A.

The controller 41 controls a driver 42B formed by, for example, a drive motor. Specifically, the controller 41 controls, based on the detection results of the sheet-reception-position detection sensor 61 and the sheet-delivery-position detection sensor 62, the position (height position) of the first tray 21 with the driver 42B. The driver 42B moves the first tray 21 in the up-down direction.

The controller 41 controls a driver 42C formed by, for example, a drive motor. Specifically, the controller 41 controls the position of the second tray 22 by controlling, based on the detection result of the switch 72, the position (in the front-rear direction) of the second tray base 23 with the driver 42C. That is, the driver 42C moves the second tray 22 in the front-rear direction, and can move the second tray 22 outside the stacker device 1.

The controller 41 controls a driver 42D formed by, for example, a drive motor. Specifically, the controller 41 controls, based on the detection results of the switches 71 and 73, the position (height position) of the shutter 12 with the driver 42D. That is, the driver 42D can move the shutter 12 in the up-down direction.

The setting unit 52 includes an input unit 52A and an output unit 52B. The input unit 52A is formed by, for example, a touch panel. The output unit 52B is formed by, for example, a liquid crystal display. That is, the setting unit 52 functions as a liquid crystal display with a touch panel.

The stacker device 1 includes a communication unit 53 that communicates with a device, such as a smartphone 81 or a remote controller. For example, execution of the automatic outside-discharging processing may be controlled by a device, such as the smartphone 81 or the remote controller. The communication unit 53 communicates with an image forming apparatus 5.

The stacker device 1 includes a power supply unit 43 that supplies power to loads constituting the stacker device 1. The switches 71 to 73 can execute power shutoff control for supplying or shutting off power from the power supply unit 43 by opening and closing. The opening/closing states of the switches 71 to 73 indicate the result of the power shutoff control, and are output to the controller 41. The controller 41 can control the driver 42B according to the result of the power shutoff control input from the switches 71 to 73 (to be detailedly described later).

The image forming apparatus 5 shown in FIG. 3 is provided at the front stage of the stacker device 1 and forms images on sheets. The image forming apparatus 5 supplies the sheets on which the images are formed to the discharger 16.

As described above, when the shutter 12 of the stacker device 1 is opened, the power supply to the drive parts is shut off, and the sheet stacking operation is temporarily suspended, which causes a decrease in the sheet productivity. The decrease in the sheet productivity depends on the position of the shutter 12 which is a trigger of the power shutoff causing the suspension of the stacking operation.

Figure 4A:
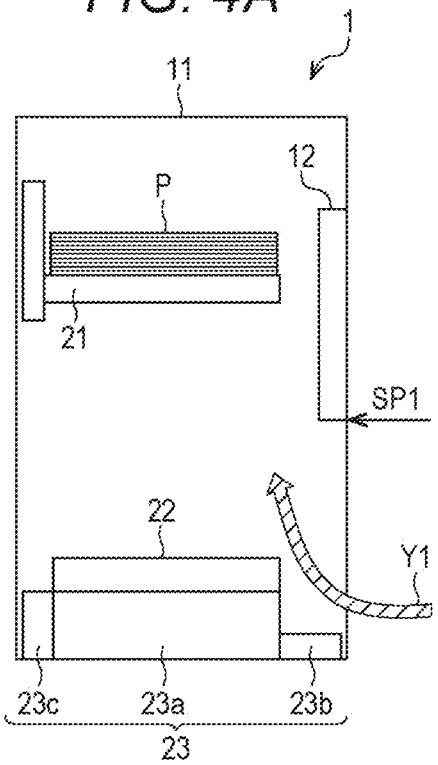
FIG. 4A and FIG. 4B show a comparative example when a power shutoff position of a shutter is high.
Figure 4B:
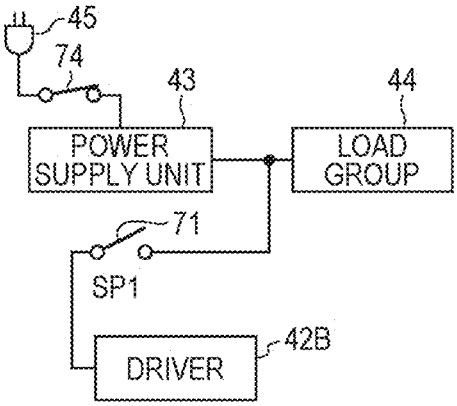

FIG. 4A and FIG. 4B show a comparative example when a power shutoff position of the shutter 12 is high. A reference sign SP1 in FIG. 4A indicates a power shutoff position for suspending the operation of stacking the sheets P when the shutter 12 is half-opened and the lower end of the shutter 12 reaches the position. FIG. 4B is a diagram of a power shutoff circuit constituted by the switch 71.

As shown in FIG. 4B, the power supplied from the power supply unit 43 is supplied to the driver 42B and a load group 44. The load group 44 is a group of loads excluding the load of the driver 42B among various loads constituting the stacker device 1. The load group 44 includes, for example, the drivers 42A, 42C, and 42D (FIG. 3).

The switch 71 controls the power supply to the driver 42B. The switch 71 opens (OFF) when the fully closed shutter 12 is half-opened (moves upward) and the lower end of the shutter 12 reaches the power shutoff position SP1, and shuts off the power supply to the driver 42B. The switch 71 closes (ON) when the fully opened shutter 12 is closed (moves downward) and the lower end of the shutter 12 reaches the power shutoff position SP1, and supplies power to the driver 42B.

The power supply unit 43 is connected to a power supply plug 45 via a switch 74. The switch 74 can be a power shutoff switch corresponding to the opening and closing of the front door (not shown) of the stacker device 1, but this does not participate in the present invention.

As shown in FIG. 4A, when the power shutoff position SP1 is set to a high position, the distance until the lower end of the shutter 12 reaches the power shutoff position SP1 by opening the fully closed shutter 12 becomes relatively long. Thus, it is not easy to satisfy the condition for shutting off the power to the driver 42B. Accordingly, it becomes easy to continue the operation of stacking the sheets P, and it can be said that the productivity is high.

However, at the time when the lower end of the shutter 12 reaches the power shutoff position SP1, the area of the opening 13 (FIG. 2) covered by the shutter 12 is relatively small, and the opening on the front side of the stacker device 1 is considerably large. Accordingly, although the lower end of the shutter 12 does not reach the power shutoff position SP1, it is easy to put a hand or a finger inside the stacker device 1 as shown by the arrow Y1 in FIG. 4A. Nevertheless, since the lower end of the shutter 12 has not reached the power shutoff position SP1, the power supply to the driver 42B is not suspended while the stacking operation is suspended. In this case, an accident of catching a hand or a finger put inside the stacker device 1 in the first tray 21 that is out of control for some reason can occur. For this reason, in order to secure the necessary safety, it is unpreferable to set the power shutoff position SP1 to a high position.

In addition, the second tray 22 is detachable from the second tray base 23, but when the second tray base 23 is housed in the stacker device 1 without the second tray 22, the space inside the stacker device 1 becomes larger, and this makes is easier to put a hand and fingers inside the stacker device 1. For this reason, in order to secure the necessary safety, it is more unpreferable to set the power shutoff position SP1 to a high position.

Figure 5A:
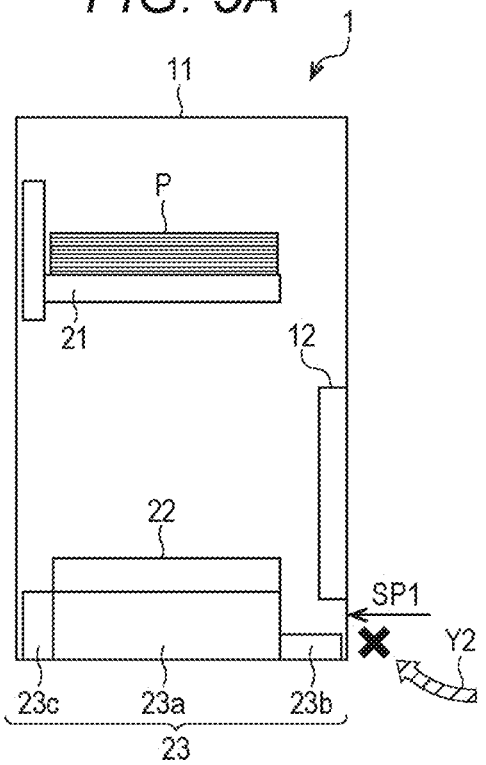
FIG. 5A to FIG. 5C show a comparative example when a power shutoff position of the shutter is low.
Figure 5B:
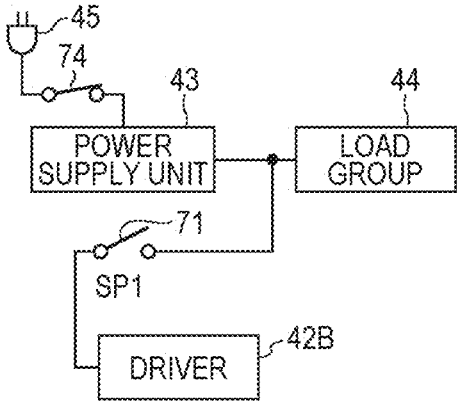
Figure 5C:
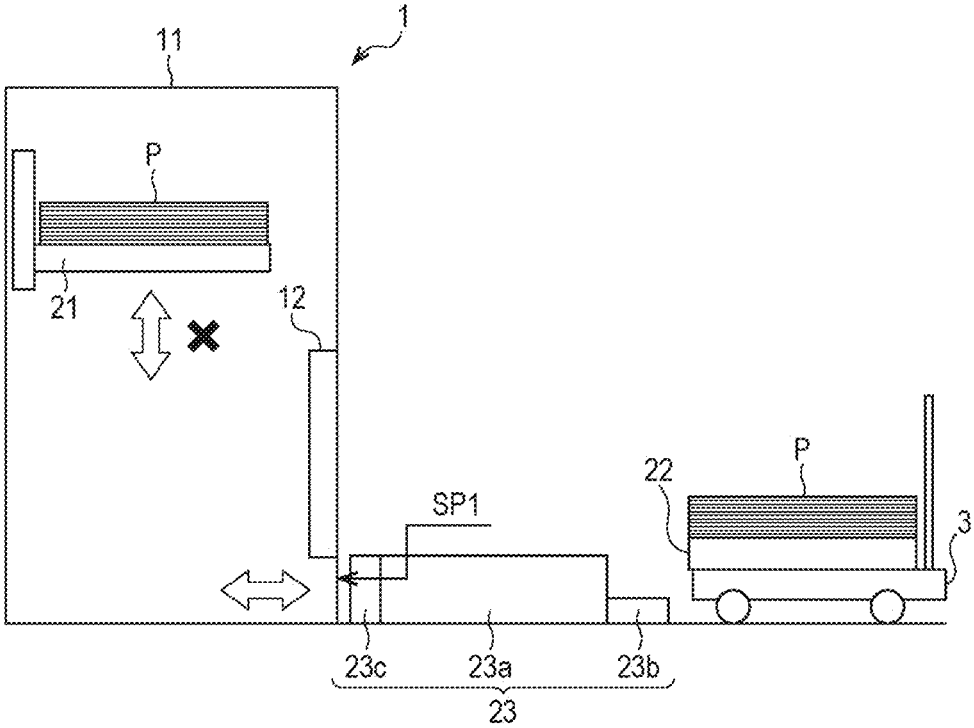

FIG. 5A to FIG. 5C are a comparative example when the power shutoff position of the shutter 12 is low. The power shutoff position SP1 shown in FIG. 5A is below the power shutoff position SP1 shown in FIG. 4A. The diagram of the power shutoff circuit shown in FIG. 5B is the same as the diagram of the power shutoff circuit shown in FIG. 4A.

As shown in FIG. 5A, when the power shutoff position SP1 is set to a low position, the distance until the lower end of the shutter 12 reaches the power shutoff position SP1 by opening the fully closed shutter 12 becomes relatively short. Thus, it is easy to satisfy the condition for shutting off the power to the driver 42B. That is, if the shutter 12 is opened slightly, the power supply to the driver 42B is suspended, and the stacking operation can be suspended. In this case, at the time when the lower end of the shutter 12 reaches the power shutoff position SP1, the area of the opening 13 (FIG. 2) covered by the shutter 12 is relatively large, and the opening on the front side of the stacker device 1 is considerably small. Accordingly, although the lower end of the shutter 12 is moved upward from the power shutoff position SP1, it is difficult to put a hand or a finger inside the stacker device 1 as shown by the arrow Y2 in FIG. 5A. Thus, it is preferable to set the power shutoff position SP1 to a low position to secure the necessary safety.

However, since the distance until the lower end of the shutter 12 reaches the power shutoff position SP1 by opening the fully closed shutter 12 is relatively short, it is easy to satisfy the condition for shutting off the power to the driver 42B. Accordingly, it becomes difficult to continue the operation of stacking the sheets P, and it can be said that the productivity is low.

In particular, as shown in FIG. 5C, as long as the shutter 12 is opened by the height dimension of the second tray base 23 in order to just house the second tray base 23 on which the second tray 22 is not placed inside the stacker device 1 or just take the second tray base 23 out of the stacker device 1, the lower end of the shutter 12 moves upward from the power shutoff position SP1. For this reason, the operation of stacking the sheets P has to be suspended every time the second tray base 23 on which the second tray 22 is not placed is taken in and out, which causes a decrease in the productivity.

Note that, a reference sign 3 shown in FIG. 5C is a dolly for carrying the second tray 22, on which the sheets P are stacked, transferred from the second tray base 23.

In view of the above circumstances, the stacker device 1 according to the present embodiment supplies or shuts off power to the driver 42B with the controller 41, based on a combination of the height position of the shutter 12 and the taken-out position of the second tray base 23, that is, the position in the front-rear direction. With this combination, the productivity is to be improved by continuing the operation of stacking the sheets P although the shutter 12 is slightly opened while the safety that a hand or a finger cannot be put inside the stacker device 1 is secured.

Figure 6A:
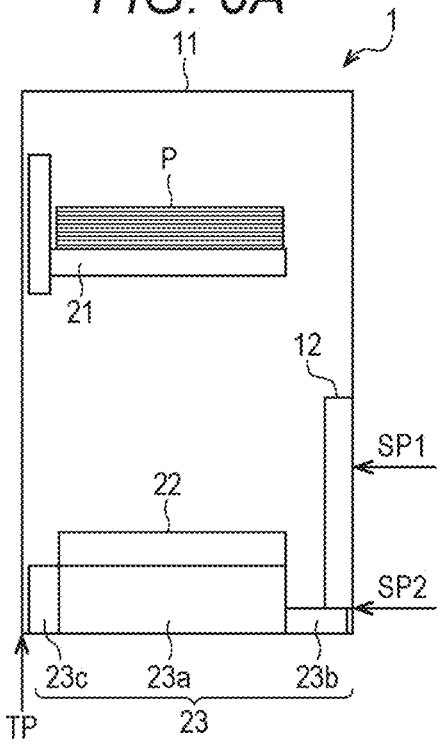
FIG. 6A and FIG. 6B are diagrams for explaining a stacking operation (part 1) in the present embodiment.
Figure 6B:
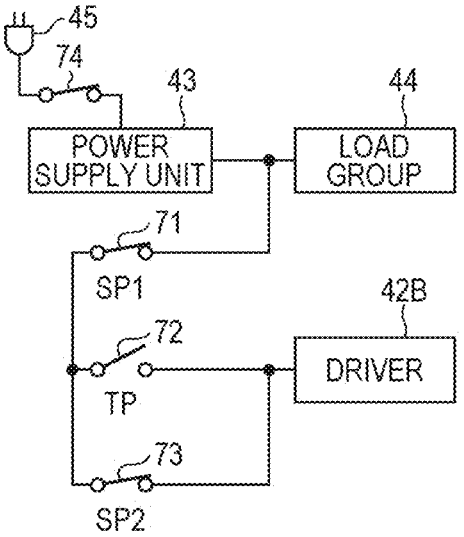

FIG. 6A and FIG. 6B are diagrams for explaining a stacking operation (part 1) in the present embodiment. FIG. 6A is a left side view of the stacker device 1. As shown in FIG. 6A, when the shutter 12 is fully closed and the first tray 21 is positioned at the uppermost position (sheet reception position), the controller 41 (FIG. 3) can execute a stacking operation for stacking the sheets P on the first tray 21.

A reference sign SP1 in FIG. 6A indicates a power shutoff position in the present embodiment for suspending the operation of stacking the sheets P when the shutter 12 is half-opened and the lower end of the shutter 12 reaches the position. The power shutoff position SP1 is a position at which the lower end of the shutter 12 can discharge the sheets P stacked on the second tray 22 placed on the second tray base 23 outside the stacker device 1, and is a position at which the shutter 12 is half-opened to an extent that the stacked sheets P are dischargeable outside the stacker device 1. The power shutoff position SP1 can be set, for example, to a position higher than the height position of the upper face of the second tray 22 placed on the second tray base 23 by a predetermined amount.

A reference sign TP shown in FIG. 6A indicates a power shutoff position which is the position of the rear face of the housing 11 in the front-rear direction. When the second tray base 23 is housed inside the stacker device 1, the rear end 23*c* of the second tray base 23 is in contact with the rear face of the housing 11 and is aligned with the power shutoff position TP.

A reference sign SP2 shown in FIG. 6A indicates a power shutoff position which is the height position of the lower end of the fully closed shutter 12. When the second tray base 23 is housed inside the stacker device 1, the handle portion 23*b* is positioned below the shutter 12. Accordingly, the lower end of the fully closed shutter 12 is in contact with the handle portion 23*b*, and the power shutoff position SP2 is aligned with the height position of the upper face of the handle portion 23*b*.

FIG. 6B is a diagram of a power shutoff circuit constituted by the switches 71 to 73. The switch 71 opens (OFF) when the fully closed shutter 12 is half-opened (moves upward) and the lower end of the shutter 12 reaches the power shutoff position SP1, and shuts off the power supply to the driver 42B. The switch 71 closes (ON) when the fully opened shutter 12 is closed (moves downward) and the lower end of the shutter 12 reaches the power shutoff position SP1, and supplies power to the driver 42B if a predetermined condition is satisfied.

The switch 72 remains closed (ON) until the second tray base 23 is housed inside the stacker device 1 and the rear end 23*c* of the second tray base 23 reaches the power shutoff position TP. The switch 72 opens (OFF) when the rear end 23*c* of the second tray base 23 reaches the power shutoff position TP and the second tray base 23 is housed.

The switch 73 opens (OFF) when the shutter 12 is opened (moved upward) and the lower end of the shutter 12 is positioned above the power shutoff position SP2. In addition, the switch 73 closes (ON) when the shutter 12 is fully closed and the lower end of the shutter 12 reaches the power shutoff position SP2.

As shown in FIG. 6B, in the present embodiment, the connection form of the switches 71 to 73 is to be one-series/two-parallel connection in which the switches 71 and 72 are connected in series, the switches 71 and 73 are connected in series, and the switches 72 and 73 are connected in parallel. When the switch 71 is closed and when at least one of the switches 72 and 73 is closed, power is supplied to the driver 42B. In other words, the controller 41 that receives the result of the power shutoff control from the switches 71 to 73 shuts off the power according to a combination of the opening/closing states of the switches 71 to 73. The combination of the opening/closing states of the switches 71 to 73 is determined based on the height position of the shutter 12 with respect to the power shutoff positions SP1 and SP2, and the position of the second tray base 23 in the front-rear direction with respect to the power shutoff position TP, and the power shutoff is executed without software control.

As shown in FIG. 6A and FIG. 6B, when the second tray base 23 is housed inside the stacker device 1 and the shutter 12 is fully closed, the lower end of the shutter 12 is positioned below the power shutoff position SP1, and the switch 71 closes (ON). In addition, the rear end 23*c* of the second tray base 23 reaches the power shutoff position TP, and the switch 72 opens (OFF). Furthermore, the lower end of the shutter 12 reaches the power shutoff position SP2, and the switch 73 closes (ON). Accordingly, the energization of supplying the power from the power supply unit 43 to the driver 42B is performed via the switches 71 and 73, and the stacker device 1 can execute the operation of stacking the sheets P on the first tray 21. At this time, since the shutter 12 is fully closed, neither a hand nor a finger can be put inside the stacker device 1, and the safety is high.

Furthermore, as shown in FIG. 6A, it is assumed that the shutter 12 is accidentally slightly opened when the second tray base 23 is housed inside the stacker device 1 and the shutter 12 is fully closed. In this case, the lower end of the shutter 12 moves upward from the power shutoff position SP2, and the switch 73 opens (OFF). Accordingly, since the switch 73 remains opened (OFF), the power from the power supply unit 43 to the driver 42B is shut off, and the operation of stacking the sheets P is immediately suspended. Thus, it is possible to secure the safety when the shutter 12 is inadvertently slightly opened.

The controller 41 can determine the height position of the shutter 12 based on the position of the second tray base 23 in the front-rear direction. For example, the controller 41 can execute operation control of the shutter 12 and the second tray base 23 so as to change the height position of the shutter 12 according to the height of the upper face of the second tray base 23 that moves outside the stacker device 1 or moves inside the stacker device 1. With this operation control, it is possible to prevent a gap from being generated between the shutter 12 and the second tray base 23 while the second tray base 23 is being taken in and out, and neither a hand nor a finger can be put inside the stacker device 1. Thus, it is possible to secure the necessary safety.

The above operation control applies not only to the case where the second tray 22 is not placed on the second tray base 23, but also to the case where the second tray 22 is placed. That is, the controller 41 can execute operation control of the shutter 12 and the second tray base 23 so as to change the height position of the shutter 12 according to the height of the upper face of the second tray 22 placed on the second tray base 23 that moves outside the stacker device 1 or moves inside the stacker device 1. As a result, it is possible to prevent a gap from being generated between the shutter 12 and the second tray 22 while the second tray base 23 on which the second tray 22 is placed is being taken in and out, and neither a hand nor a finger can be put inside the stacker device 1. Thus, it is possible to secure the necessary safety.

Figure 7A:
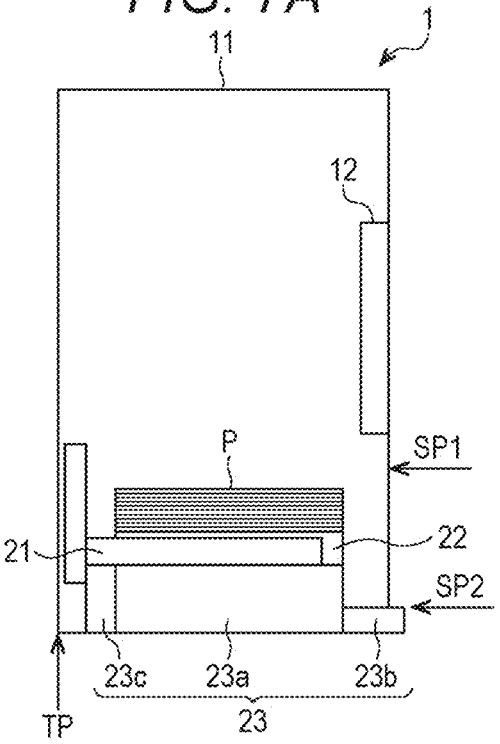
FIG. 7A and FIG. 7B are diagrams for explaining the stacking operation (part 2) in the present embodiment.
Figure 7B:
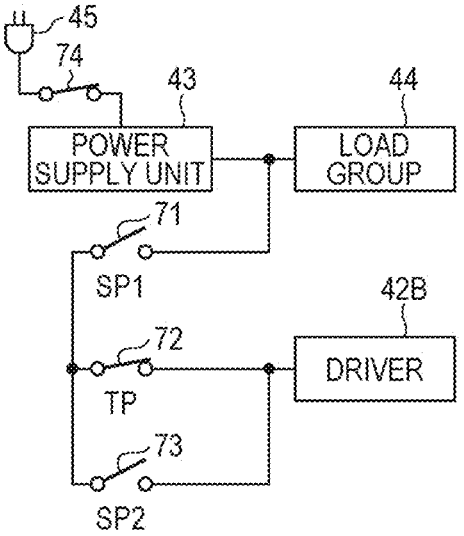

FIG. 7A and FIG. 7B are diagrams for explaining the stacking operation (part 2) in the present embodiment. FIG. 7A is a left side view of the stacker device 1. As shown in FIG. 7A, when the first tray 21 is lowered to the lowermost position (sheet delivery position) and the sheets P stacked on the first tray 21 are delivered to the second tray 22, the shutter 12 is almost fully opened (the opening amount of the shutter 12 is only required to an amount according to the amount of the stacked sheets P) in order to discharge the sheets P outside the stacker device 1.

As shown in FIG. 7A and FIG. 7B, when the shutter 12 is almost fully opened, the lower end of the shutter 12 is positioned above the power shutoff position SP1, and the switch 71 opens (OFF). Accordingly, regardless of the opening/closing states of the switches 72 and 73, the power supply from the power supply unit 43 to the driver 42B is shut off, and the stacker device 1 cannot execute the operation of stacking the sheets P on the first tray 21 (elevation of the first tray 21). However, although the shutter 12 is opened and a hand or a finger can be put inside the stacker device 1, the first tray 21 is positioned at the lowermost position, and an accident of catching the hand or the finger in the first tray 21 does not occur. Thus, it can be said that the safety is high.

Figure 8A:
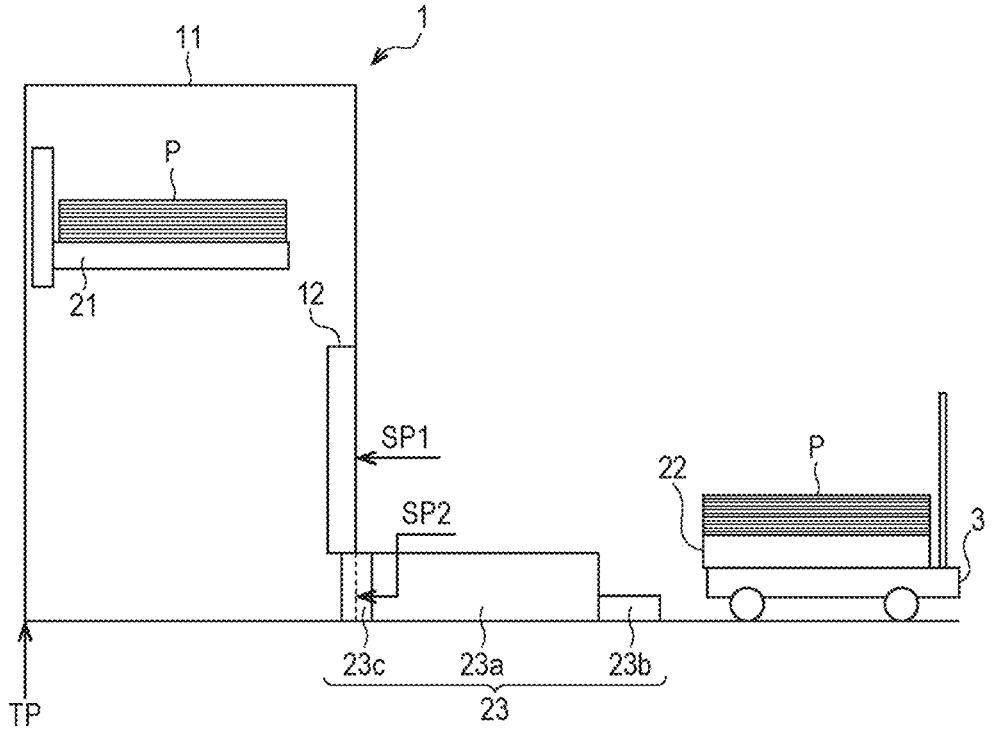
FIG. 8A and FIG. 8B are diagrams for explaining a discharging operation.
Figure 8B:
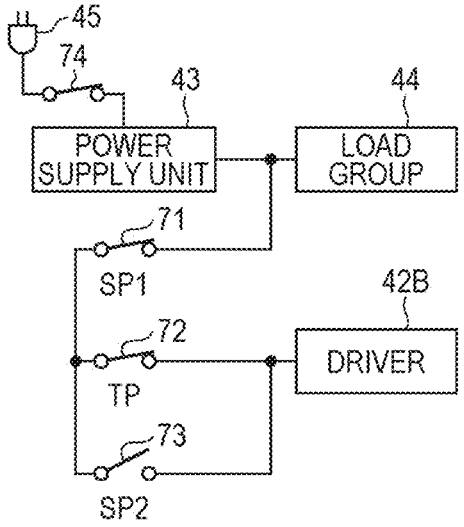

FIG. 8A and FIG. 8B are diagrams for explaining a discharging operation in the present embodiment. FIG. 8A is a left side view of the stacker device 1. As shown in FIG. 8A, the second tray base 23 is pulled out while the second tray 22 on which the sheets P are stacked is placed on the second tray base 23, and the shutter 12 is closed so as to be in contact with the rear end 23*c* engaged with the front lower edge of the housing 11. At this time, the controller 41 (FIG. 3) can execute the operation of stacking the sheets P on the first tray 21 while the second tray 22 on which the sheets P are stacked is being delivered to the dolly 3 and carried to the outside.

As shown in FIG. 8A and FIG. 8B, when the shutter 12 is closed so as to be in contact with the rear end 23*c* engaged with the front lower edge of the housing 11, the lower end of the shutter 12 is positioned below the power shutoff position SP1, and the switch 71 closes (ON). In addition, the rear end 23*c* of the second tray base 23 is separated from the power shutoff position TP, and the switch 72 closes (ON).

Furthermore, since the upper face of the rear end 23*c* of the second tray base 23 is at a position above the upper face of the handle portion 23*b* of the second tray base 23, the lower end of the shutter 12 does not reach the power shutoff position SP2, and the switch 73 opens (OFF).

Accordingly, the energization of supplying the power from the power supply unit 43 to the driver 42B is performed via the switches 71 and 72, and the stacker device 1 can execute the operation of stacking the sheets P on the first tray 21. At this time, since the shutter 12 is closed in contact with the rear end 23*c*, neither a hand nor a finger can be put inside the stacker device 1, and the safety is high.

Figure 9A:
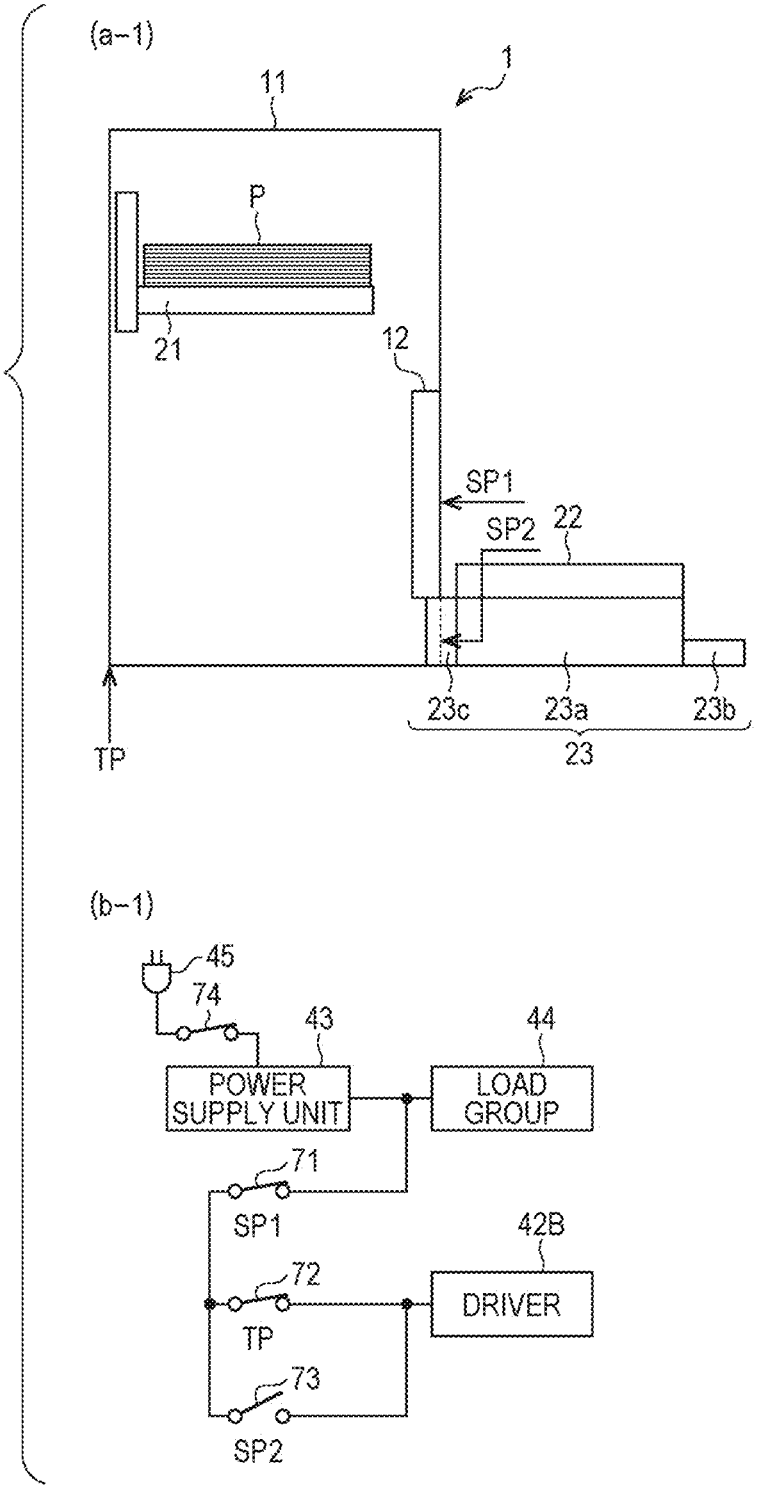
FIG. 9A shows diagrams for explaining an operation of housing the second tray base on which a second tray is placed, FIG. 9A (a-1) is a diagram showing a transition of the housing operation, and FIG. 9A (b-1) is a diagram of the power shutoff circuit corresponding to FIG. 9A (a-1)
Figure 9B:
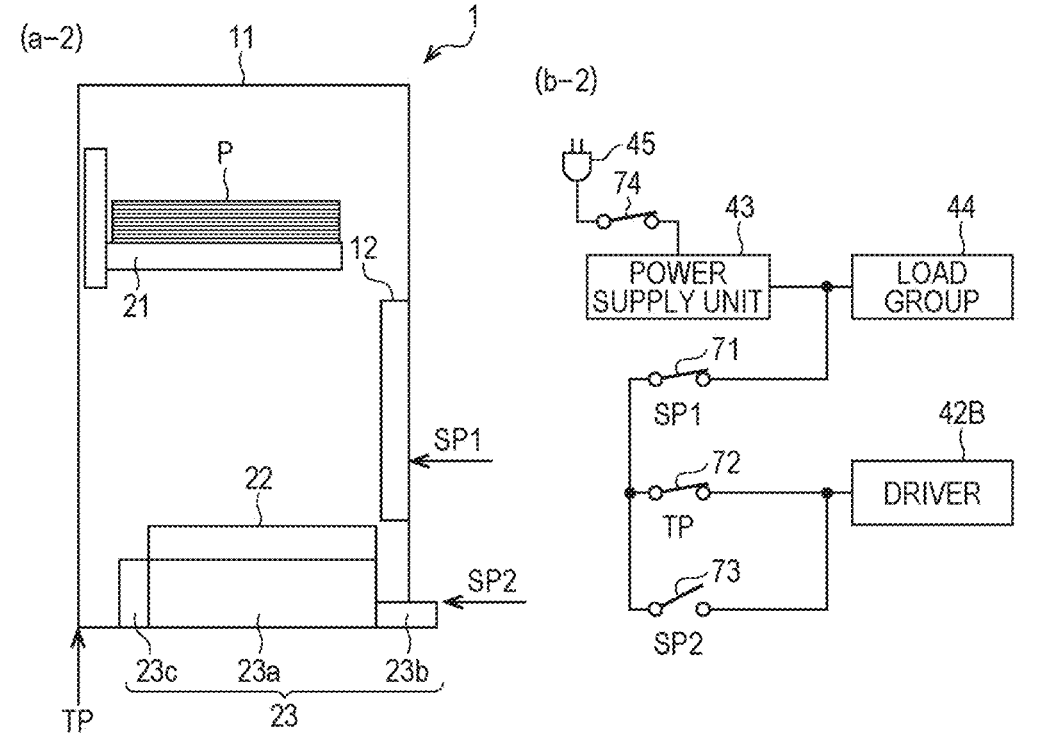
FIG. 9B shows diagrams for explaining an operation of housing the second tray base on which the second tray is placed, FIG. 9B (a-2) is a diagram showing a transition of the housing operation, and FIG. 9B (b-2) is a diagram of the power shutoff circuit corresponding to FIG. 9B (a-2)
Figure 9C:
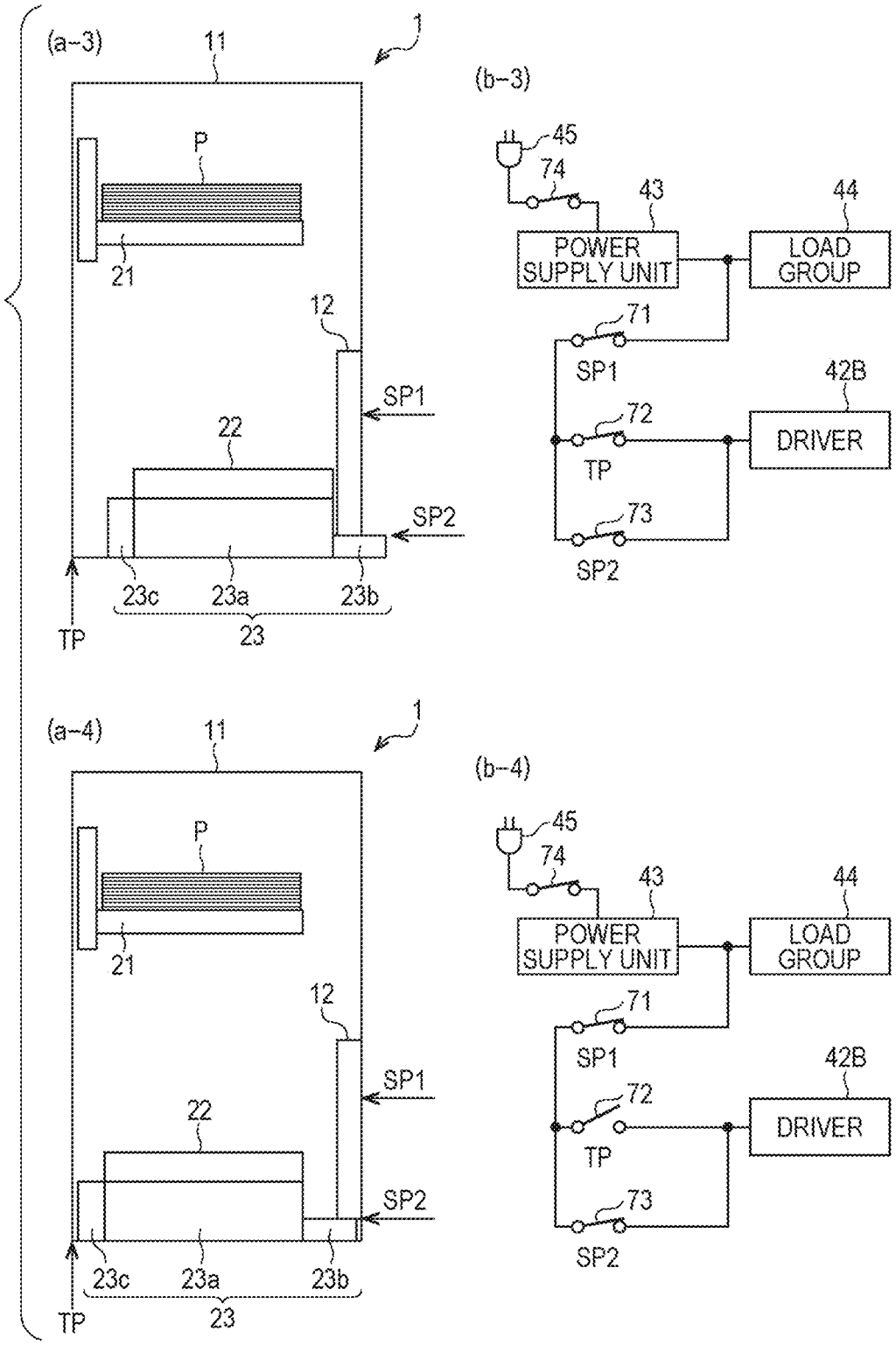
FIG. 9C shows diagrams for explaining an operation of housing the second tray base on which the second tray is placed, FIG. 9C (a-3) and (a-4) are diagrams showing transitions of the housing operation, and FIG. 9C (b-3) and (b-4) are diagrams of the power shutoff circuit corresponding to FIG. 9C (a-3) and (a-4) respectively.

FIG. 9A to FIG. 9C are diagrams for explaining an operation of housing the second tray base on which the second tray is placed. As shown in FIG. 9A (a-1), after the sheets P are carried by the dolly 3 (see FIG. 8A and FIG. 8B), a housing operation in which the second tray 22 is placed on the second tray base 23 pulled out of the stacker device 1 and the second tray 22 and the second tray base 23 are housed inside the stacker device 1 is executed.

FIG. 9A (b-1) is a diagram of the power shutoff circuit corresponding to FIG. 9A (a-1). In FIG. 9A (a-1), the shutter 12 is closed in contact with the rear end 23*c* engaged with the front lower edge of the housing 11 as in FIG. 8A. Thus, the diagram of the power shutoff circuit shown in FIG. 9A (b-1) is the same as the diagram of the power shutoff circuit shown in FIG. 8B.

Accordingly, the energization of supplying the power from the power supply unit 43 to the driver 42B is performed via the switches 71 and 72, and the stacker device 1 can execute the operation of stacking the sheets P on the first tray 21. At this time, since the shutter 12 is closed in contact with the rear end 23*c*, neither a hand nor a finger can be put inside the stacker device 1, and the safety is high.

After the state of FIG. 9A (a-1), the shutter 12 is half-opened to house the second tray base 23 on which the second tray 22 is placed, as shown in FIG. 9B (a-2). The amount of upward movement of the shutter 12 at this time is the amount of movement for the lower end of the shutter 12 to be above the position of the upper face of the second tray placed on the second tray base 23 and to be below the power shutoff position SP1.

FIG. 9B (b-2) is a diagram of the power shutoff circuit corresponding to FIG. 9B (a-2). As shown in FIG. 9B (a-2) and (b-2), although the shutter 12 is half-opened, the lower end of the shutter 12 is not to be positioned above the power shutoff position SP1, and the switch 71 remains closed (ON). In addition, the rear end 23*c* of the second tray base 23 remains separated from the power shutoff position TP, and the switch 72 remains closed (ON). Furthermore, the lower end of the shutter 12 moved upward due to the half-opening does not reach the power shutoff position SP2, and the switch 73 remains opened (OFF).

Accordingly, the energization of supplying the power from the power supply unit 43 to the driver 42B is maintained via the switches 71 and 72, and the stacker device 1 can continue the operation of stacking the sheets P on the first tray 21. At this time, although the shutter 12 is half-opened because of the second tray, neither a hand nor a finger can be put inside the stacker device 1, and the safety is high.

After the state of FIG. 9B (a-2), the shutter 12 is fully closed at the timing when the second tray 22 is completely housed inside the stacker device 1 and most of the second tray base 23 is housed inside the stacker device 1, as shown in FIG. 9C (a-3). Thus, the lower end of the shutter 12 is brought into contact with the upper face of the handle portion 24*b* of the second tray base 23, and reaches the power shutoff position SP2.

FIG. 9C (b-3) is a diagram of the power shutoff circuit corresponding to FIG. 9C (a-3). As shown in FIG. 9C (a-3) and (b-3), when the lower end of the shutter 12 reaches the power shutoff position SP2, the lower end of the shutter 12 is positioned below the power shutoff position SP1, and the switch 71 remains closed (ON). In addition, the rear end 23*c* of the second tray base 23 remains separated from the power shutoff position TP, and the switch 72 remains closed (ON). Furthermore, the lower end of the shutter 12 has reached the power shutoff position SP2, and the switch 73 closes (ON).

Accordingly, the energization of supplying the power from the power supply unit 43 to the driver 42B is maintained via the switches 71 to 73, and the stacker device 1 can continue the operation of stacking the sheets P on the first tray 21. At this time, since the shutter 12 is fully closed, neither a hand nor a finger can be put inside the stacker device 1, and the safety is high.

After the state of FIG. 9C (a-3), when the handle portion 23*b* of the second tray base 23 is also housed inside the stacker device 1 and the entire second tray base 23 is completely housed inside the stacker device 1, the housing is completed, as shown in FIG. 9C (a-4). At this time, the lower end of the shutter 12 remains in contact with the upper face of the handle portion 24*b* of the second tray base 23, and remains at the power shutoff position SP2. In addition, the rear end 23*c* of the second tray base 23 is brought into contact with the rear face of the housing 11, and reaches the power shutoff position TP.

FIG. 9C (b-4) is a diagram of the power shutoff circuit corresponding to FIG. 9C (a-4). As shown in FIG. 9C (a-4) and (b-4), since the lower end of the shutter 12 remains at the power shutoff position SP2 and the lower end of the shutter 12 is positioned below the power shutoff position SP1, the switch 71 remains closed (ON). In addition, the rear end 23*c* of the second tray base 23 reaches the power shutoff position TP, and the switch 72 opens (OFF). In addition, the lower end of the shutter 12 remains as the power shutoff position SP2, and the switch 73 remains closed (ON).

Accordingly, the energization of supplying the power from the power supply unit 43 to the driver 42B is maintained via the switches 71 and 73, and the stacker device 1 can continue the operation of stacking the sheets P on the first tray 21. At this time, since the shutter 12 is fully closed, neither a hand nor a finger can be put inside the stacker device 1, and the safety is high.

Figures 10A, 10B, 10C:
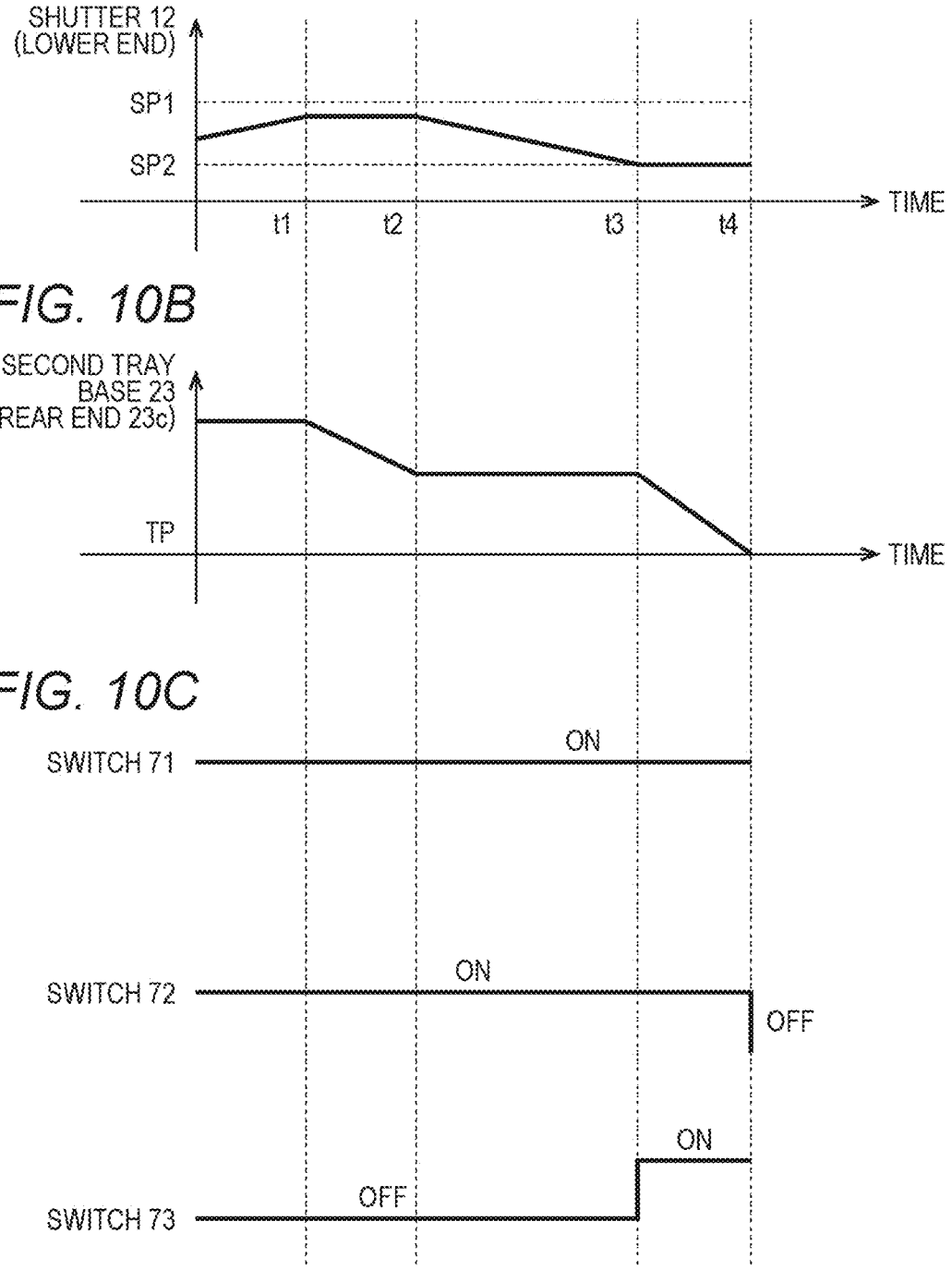
FIG. 10A to 10C are time charts of electric signals generated by respective switches in a housing operation.

FIG. 10A to 10C are time charts of electric signals generated by respective switches in a housing operation. FIG. 10A is a graph showing the transition of the height position of the shutter 12 (lower end). FIG. 10B is a graph showing the transition of the position of the rear end 23*c* of the second tray base 23 in the front-rear direction. FIG. 10C shows the transition of the amplitudes of electrical signals generated by the switches 71 to 73.

The state of FIG. 9A (a-1) is indicated as the states at time 0 in the housing operation shown in FIG. 10A to FIG. 10C. First, the controller 41 raises the lower end of the shutter 12 from the height position of the upper face of the rear end 23*c* of the second tray base 23 to the height position of the upper face of the second tray 22 placed on the second tray base 23. The time of the raising completion is t1. During the period from time 0 to t1, the controller 41 does not move the second tray base 23 inside the stacker device 1. The lower end of the shutter 12 after the raising is positioned below the power shutoff position SP1.

Next, the controller 41 moves the second tray base 23 on which the second tray 22 is placed inside the stacker device 1. The time of the moving completion is t2. During the period from time t1 to t2, the controller 41 does not move the shutter 12. The state of FIG. 9B (a-2) is indicated as the state at time t2 in the housing operation. As shown in FIG. 9B (a-2), the second tray 22 is positioned behind the shutter 12, and is housed inside the stacker device 1 at time t2. Meanwhile, the handle portion 23*b* of the second tray base 23 is positioned below the shutter 12, and the entire second tray base 23 is not housed inside the stacker device 1.

Next, the controller 41 fully closes the shutter 12. The time of the closing completion is t3. During the period from time t2 to t3, the controller 41 does not move the second tray base 23 inside the stacker device 1. The state of FIG. 9C (a-3) is indicated as the state at time t3 in the housing operation. As shown in FIG. 9C (a-3), the lower end of the shutter 12 is in contact with the upper face of the handle portion 23*b* of the second tray base 23 at time t3.

Next, the controller 41 moves the entire second tray base 23 on which the second tray 22 is placed inside the stacker device 1. The time of the moving completion is t4. During the period from time t3 to t4, the controller 41 does not move the shutter 12. The state of FIG. 9C (a-4) is indicated as the state at time t4 in the housing operation. As shown in FIG. 9C (a-4), the entire second tray base 23 is housed inside the stacker device 1 at time t4.

As shown in FIG. 10C, since the lower end of the shutter 12 does not move upward from the power shutoff position SP1 during the housing operation, the switch 71 continuously remains ON. Furthermore, the switch 73 switches from OFF to ON at time t3, and the switch 72 switches from ON to OFF at time t4, but both switches 72 and 73 are in the ON state during the time t3 to t4. That is, there is no period in which the switches 72 and 73 are both in the OFF state.

Thus, the controller 41 can continuously maintain the energization to the driver 42B during the housing operation. Thus, it is possible to execute the operation of housing the second tray base 23 without the suspension of the operation of stacking the sheets P caused by power shutoff. In other words, during the housing operation, it is possible to avoid the downtime which is the suspension period of the operation of stacking the sheets P, and which contributes to the improvement of the productivity. As already described with reference to FIG. 9A to FIG. 9C, the safety during the housing operation remains high. Conventionally, the downtime cannot be avoided because the power is shut off when the shutter is opened during the housing operation in order to emphasize safety, and the improvement in productivity has been limited.

Figure 11:
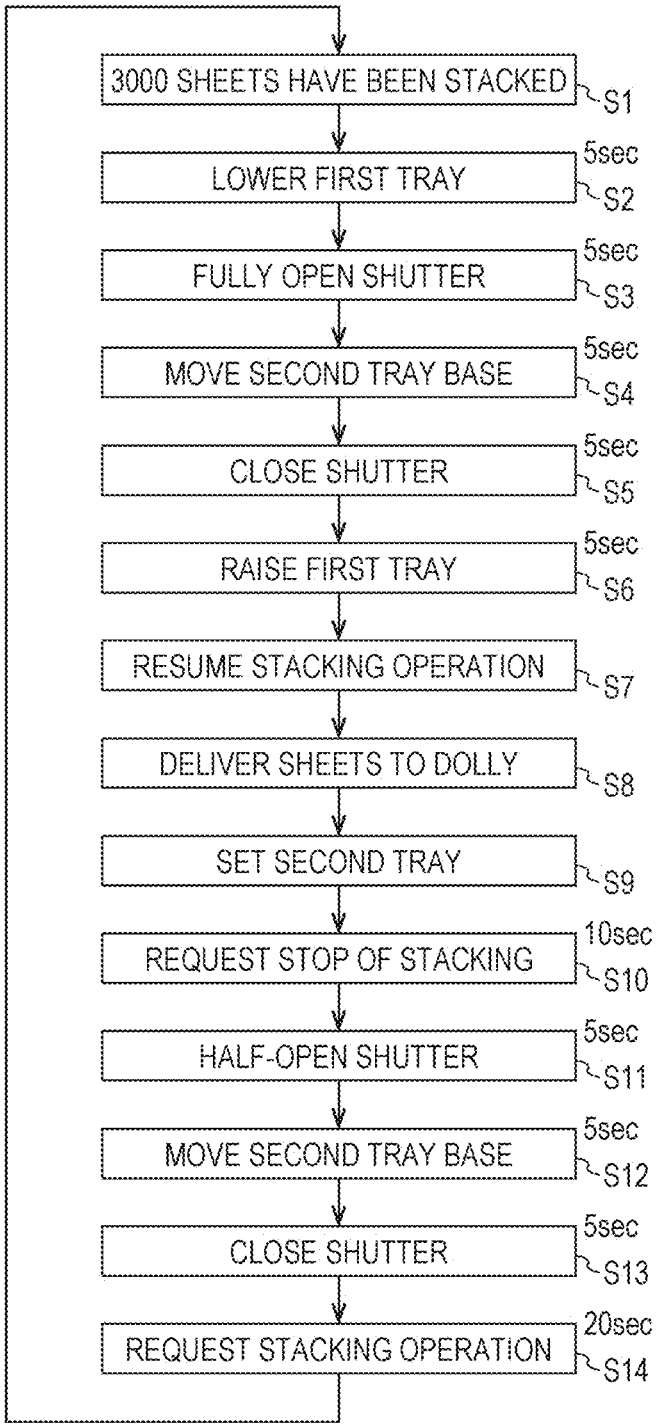
FIG. 11 shows operation procedures S1 to S14 when 3000 sheets are stacked.
Figure 12A:
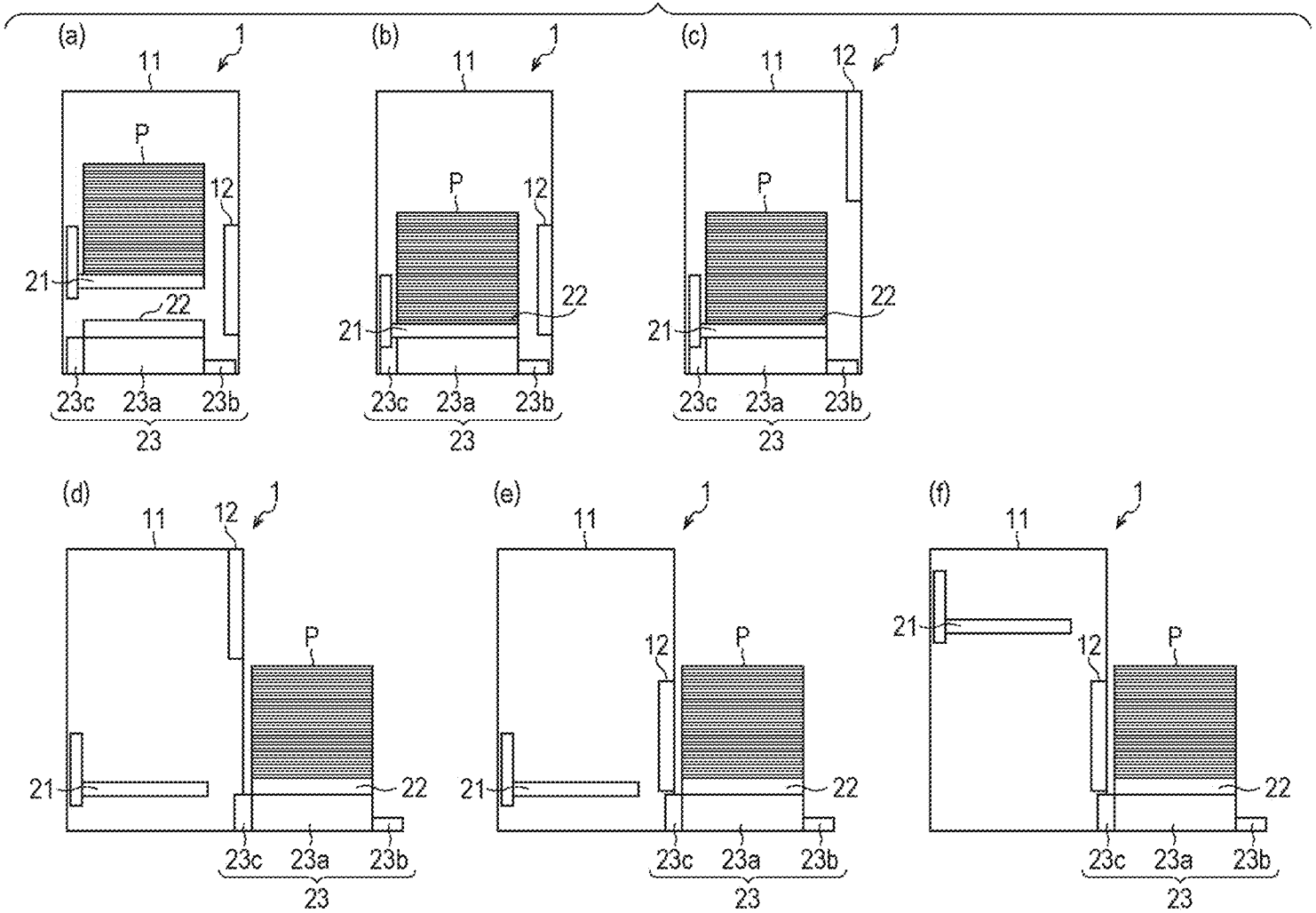
FIG. 12A shows left side views (a) to (f) of the stacker device corresponding to the respective operation procedures S1 to S6 shown in FIG. 11.
Figure 12B:
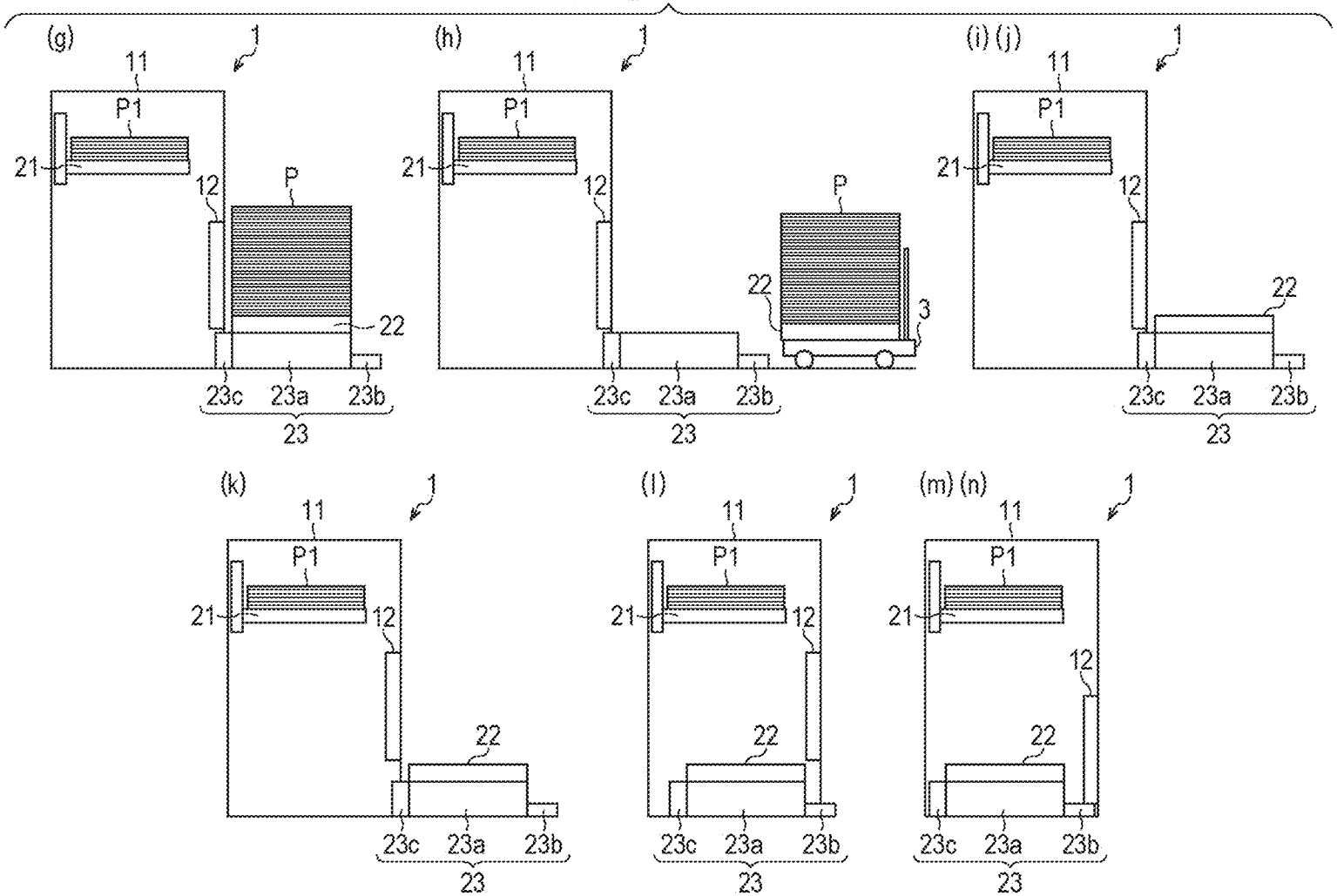
FIG. 12B shows left side views (g) to (n) of the stacker device corresponding to the respective operation procedures S7 to S14 shown in FIG. 11.

A specific example that can quantitatively evaluate the efficacy of the present embodiment is described. FIG. 11 shows operation procedures S1 to S14 when 3000 sheets are stacked. FIG. 12A shows left side views (a) to (f) of the stacker device corresponding to the respective operation procedures S1 to S6 shown in FIG. 11. FIG. 12B shows left side views (g) to (n) of the stacker device corresponding to the respective operation procedures S7 to S14 shown in FIG. 11.

First, in the stacker device 1, 3000 sheets P have been stacked on the first tray 21 (S1). Next, the controller 41 of the stacker device 1 lowers the first tray 21 from the sheet reception start position to the sheet delivery position (S2). Thus, the sheets P stacked on the first tray 21 are stacked on the second tray 22 placed on the second tray base 23.

Next, the controller 41 of the stacker device 1 fully opens the shutter 12 (S3). As a result, the whole of the sheets P stacked on the second tray base 23 is released. Next, the controller 41 of the stacker device 1 moves the second tray 22 placed on the second tray base 23 and on which the sheets P are stacked outside the stacker device 1 (S4).

Next, the controller 41 of the stacker device 1 closes the shutter 12 (S5). At this time, as described above, the lower end of the shutter 12 is in contact with the upper face of the rear end 23*c* of the second tray base 23, and is positioned below the power shutoff position SP1 and above the power shutoff position SP2. Next, the first tray 21 is raised from the sheet delivery position to the sheet reception start position (S6).

Next, the controller 41 of the stacker device 1 resumes the operation of stacking the sheets P on the first tray 21 (S7). Next, the sheets P stacked on the second tray 22 moved outside the stacker device 1 are delivered to the dolly 3 (S8). Then, the sheets P are carried to the outside. Next, the second tray 22 with no sheets P is set on the second tray base 23 (S9).

Next, in a conventional stacking operation, the controller 41 of the stacker device 1 outputs a stacking-operation suspension request to execute the operation of housing the second tray base 23 (S10). However, according to the present embodiment, the operation procedure of S10 is omitted, and the processing can be continued without suspending the stacking operation.

Next, the controller 41 of the stacker device 1 half-opens the shutter 12 (S11). At this time, as described above, the lower end of the shutter 12 is controlled so as not to be positioned above the power shutoff position SP1. Next, the controller 41 of the stacker device 1 moves the second tray 22 placed on the second tray base 23 inside the stacker device 1 (S12). At this time, the entire second tray 22 is housed inside the stacker device 1, and most of the second tray base 23 is housed inside the stacker device 1. Next, the controller 41 of the stacker device 1 fully closes the shutter 12 (S13). At this time, as described above, the lower end of the shutter 12 is brought into contact with the upper face of the handle portion 23*b* of the second tray base 23, and reaches the power shutoff position SP2. Furthermore, the controller 41 of the stacker device 1 houses the entire second tray base 23 inside the stacker device 1.

Next, in a conventional stacking operation, the controller 41 of the stacker device 1 outputs a stacking operation request and executes stacking of 3000 sheets P (S14). However, according to the present embodiment, the operation procedure of S14 is omitted because the stacking-operation suspension request (see S10) has not been originally output, and the stacking operation is continued.

Thereafter, the processing returns to the operation procedure of 51, and the stacking operation is repeated. Then, when the user's designated number of sheets on which images are formed is discharged, the operation is terminated.

It is assumed that the discharging linear velocity of the image forming apparatus 5 that discharges sheets to the stacker device 1 is 140 ppm (page per minutes). Then, it takes about 21 minutes to stack 3000 sheets. Among the operation procedures of S1 to S14, the operation procedures corresponding to downtimes are S2 to S6 and S10 to S14.

It is assumed that the time required for each of the operation procedures of S2 to S6 is 5 seconds, and the integrated value of the operation procedures of S2 to S6 is 25 sec, depending on the performance and the like of the stacker device 1. Furthermore, it is assumed that the time required for the operation procedure of S10 is 10 seconds, the time required for each of the operation procedures of S11 to S13 is 5 seconds, and the time required for the operation procedure of S14 is 20 seconds, and the integrated value of the operation procedures of S10 to S14 is 45 seconds. According to the present embodiment, the operation procedures of S10 and S14 are omitted, and the stacking operation can be continued during the operation of housing the second tray base 23. Accordingly, the downtimes corresponding to the operation procedures of S10 to S14 are eliminated, and the total downtime is reduced to about ⅓ (70 seconds→25 seconds). As a result, the productivity per hour can be improved by about 300 sheets. Furthermore, in the present embodiment, since the time during which the shutter 12 is largely open is limited (only in the operation procedures of S3 and S4), the safety of the stacking operation is sufficiently ensured.

(Operation of Housing the Second Tray Base 23 on which the Second Tray 22 is Not Placed)

Figure 13:
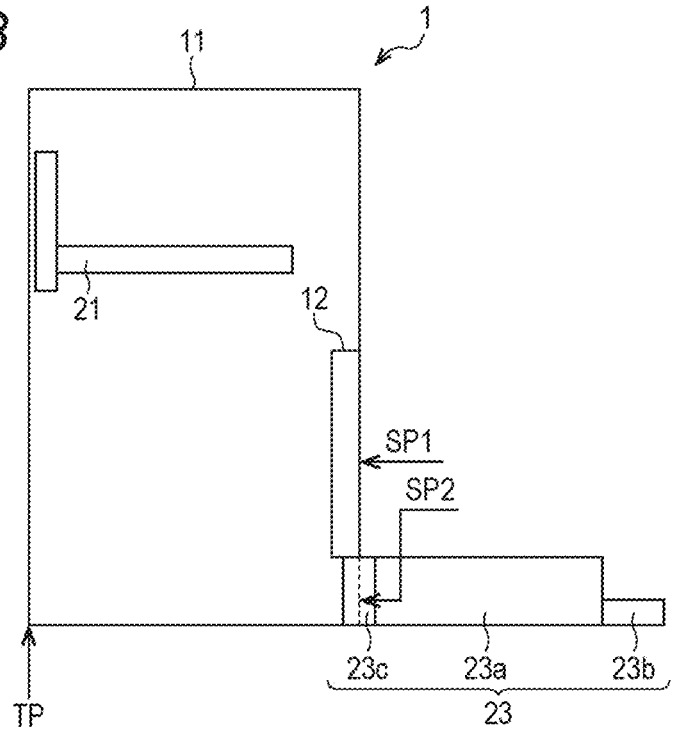
FIG. 13 is a diagram for explaining an operation of housing the second tray base on which the second tray is not placed.

In the operation of housing the second tray base 23, not the second tray base 23 on which the second tray 22 is placed (see FIG. 9A to FIG. 9C) but the second tray base 23 on which the second tray 22 is not placed is housed inside the stacker device 1 in some cases. FIG. 13 is a diagram for explaining an operation of housing the second tray base on which the second tray is not placed.

The shutter 12 is half-opened in order to house the second tray base 23 on which the second tray 22 is not placed. At this time, the amount of upward movement of the shutter 12 can be much smaller than the amount of movement when the shutter 12 is moved upward to house the second tray base 23 on which the second tray 22 is placed (FIG. 9B (a-2)). Accordingly, the amount of upward movement of the shutter 12 to house the second tray base 23 on which the second tray 22 is not placed is the amount of movement with which the lower end of the shutter 12 is positioned above the upper face of the second tray placed on the second tray base 23 and below the power shutoff position SP1.

The subsequent operation of housing the second tray base 23 on which the second tray 22 is not placed is the same as the subsequent operation of housing the second tray base 23 on which the second tray 22 is placed (FIG. 9C (a-3) and (a-4)), and the description thereof is omitted. The diagram of the power shutoff circuit corresponding to the operation of housing the second tray base 23 on which the second tray 22 is not placed is the same as the diagram of the power shutoff circuit corresponding to the operation of housing the second tray base 23 on which the second tray 22 is placed (see FIG. 9A (b-1) to FIG. 9C (b-4)), and the description thereof is omitted. In addition, the time charts of the electric signals generated by the switches in the operation of housing the second tray base 23 on which the second tray 22 is not placed are the same as those in FIG. 10A to FIG. 10C, and the description thereof is omitted.

Accordingly, in the operation of housing the second tray base 23 on which the second tray 22 is not placed, it is possible to avoid the downtime, which is the suspension period of the operation of stacking the sheets P, while the safety is highly secured, and which contributes to the improvement of the productivity.

(Operation of Housing the Second Tray Base in a Lowered State)

Figure 14:
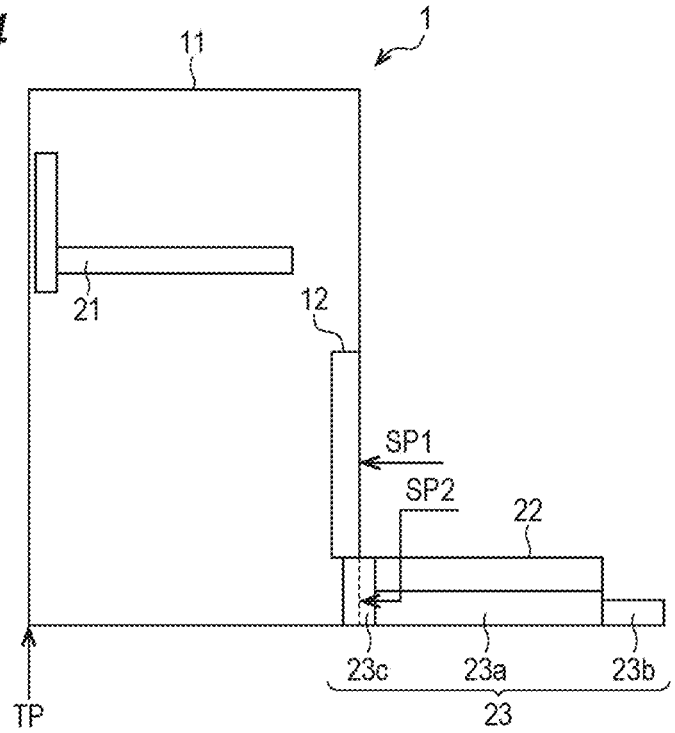
FIG. 14 is a diagram for explaining an operation of housing the second tray base on which the second tray is placed and in a lowered state.

The second tray base 23 can have an elevating function of raising the base portion 23*a* to change the height dimension of the second tray base 23 itself. The height position of the second tray 22 placed on the second tray base 23 can be changed with the elevating function. In the operation of housing the second tray base 23, the second tray base 23 on which the second tray 22 is placed and in a lowered state is housed inside the stacker device 1 in some cases. FIG. 14 is a diagram for explaining an operation of housing the second tray base on which the second tray is placed and in a lowered state.

The height position of the upper face of the second tray 22 placed on the second tray base 23 in a lowered state can be the same as the height position of the upper face of the second tray base 23 on which the second tray 22 not placed and in a raised state. Accordingly, when it is assumed that the second tray base 23 in the housing operation shown in FIG. 13 is in the raised state, the housing operation shown in FIG. 14 can be the same as the housing operation shown in FIG. 13 described above.

Thus, the diagram of the power shutoff circuit corresponding to the operation of housing the second tray base 23 on which the second tray 22 is placed and in the lowered state is the same as the diagram of the power shutoff circuit) corresponding to the operation of housing the second tray base 23 on which the second tray 22 is placed (see FIG. 9A (b-1) to FIG. 9C (b-4), and the description thereof is omitted. In addition, the time charts of the electric signals generated by the switches in the operation of housing the second tray base 23 on which the second tray 22 is placed and in the lowered state are the same as those in FIG. 10A to FIG. 10C, and the description thereof is omitted.

Accordingly, in the operation of housing the second tray base 23 on which the second tray 22 is placed and in the lowered state, it is possible to avoid the downtime, which is the suspension period of the operation of stacking the sheets P, while the safety is highly secured, and which contributes to the improvement of the productivity.

According to the present embodiment, power to at least the driver 42B of the first tray 21 is shut off based on the height position of the shutter 12 and the position of the second tray base 23 in the front-rear direction. Thus, it is possible to provide the stacker device 1 with operation procedures capable of executing the operation of stacking the sheets P while putting a hand, a finger or the like inside the stacker device 1 is prevented.

Accordingly, it is possible in sheet stacking operation of the stacker device 1 to improve the productivity while necessary safety is secured.

In particular, when the second tray 22 moved outside the stacker device 1 is housed inside the stacker device 1, it is unnecessary to suspend the operation of stacking the sheets P, and it is possible to reduce downtimes during the housing operation.

In addition, it is also possible to reduce downtimes when the second tray 22 is detachably provided to the second tray base 23 that is movable in the front-rear direction.

Furthermore, it is also possible to reduce downtimes regardless whether the second tray 22 is placed on the second tray base 23 moved outside the stacker device 1, and whether the second tray base 23 is lowered with the elevating function of the second tray base 23.

In addition, it is possible to prevent putting a hand or a finger inside the stacker device 1 by determining the height position of the shutter 12 based on the position of the second tray base 23 in the front-rear direction and whether the second tray 22 is placed on the second tray base 23, and to secure the necessary safety.

Furthermore, since the power is shut off according to the combination of opening/closing states of the switches 71 to 73, it is possible to improve the productivity at low cost while the necessary safety is secured.

In particular, by connecting the switches 71 to 73 in a one-series/two-parallel connection manner, it is possible to shut off the power.

In addition, an image forming system including the stacker device 1 according to the present embodiment and the image forming apparatus 5 can continue image forming processing according to the stacking operation in which suspension is reduced, and it is possible to improve the productivity while the necessary safety is secured.

(Modification)

(a) The present invention can be applied not only to the stacker device 1 but also to an image forming system formed as a combination of the stacker device 1 and the image forming apparatus 5 communicably connected to the stacker device 1. The image forming system may be formed by one or more stacker devices 1. In addition, the image forming system may be formed by one or more image forming apparatuses 5.

(b) The operation of stacking the sheets P on the first tray 21 can be executed although the second tray base 23 on which the second tray 22 is not placed is housed inside the stacker device 1. When the operation of discharging the sheets P is executed, the switch 71 can be disposed so as to lower the power shutoff position SP1 according to the height dimension of the second tray 22. Thus, a space is formed above the second tray base 23 because the second tray 22 is not placed, but the power shutoff is executed in the discharging operation before the shutter 12 is opened and the space is released, and it is possible to secure the safety.

(c) The functional unit that executes control of power shutoff may be formed by a CPU, an ASIC, firmware, or the like, and a memory, instead of the switches 71 to 73. In this case, it is preferable that, for example, a plurality of CPUs or the like are prepared, and a functional unit that monitors one or more positions of the shutter 12 and one or more positions of the second tray base 23 is provided to the controller 41.

(d) In the present invention, the sheets P stacked by the stacker device 1 can include sheets, films, and fabrics.

(e) The present invention can be applied to the stacker device 1 in another form in which the second tray 22 is not detachable from the second tray base 23, that is, the second tray 22 cannot be removed from the second tray base 23. In the stacker device 1 in the form, only a bundle of sheets on the second tray 22 discharged outside the stacker device 1 is taken out and carried. In addition, in the stacker device 1 in the form, since the second tray 22 and the second tray base 23 are substantially integrated, control relating to the second tray base 23 can be regarded as control relating to the second tray 22. For example, the stacker device 1 in the form can supply or shut off power to the driver 42B with the controller 41, based on the combination of the height position of the shutter 12 and the taken-out position of the second tray 22, that is, the position in the front-rear direction.

Although embodiments of the present invention have been described and illustrated in detail, the disclosed embodiments are made for purposes of illustration and example only and not limitation. The scope of the present invention should be interpreted by terms of the appended claims.

What is claimed is:

1. A stacker device comprising:

a discharger that discharges sheets in response to a print job;

a first tray on which the discharged sheets are stacked;

a second tray that serves as a delivery destination of the sheets stacked on the first tray;

a shutter that covers an opening on a front side of a housing;

a driver that moves the first tray in an up-down direction; and a hardware processor that shuts off power to the driver based on a height position of the shutter and a position of the second tray in a front-rear direction.

2. The stacker device according to claim 1, wherein when the second tray moved outside the stacker device is housed inside the stacker device, the hardware processor half-opens the shutter without moving a lower end of the shutter upward from a position at which the sheets stacked on the second tray are dischargeable outside the stacker device, and fully closes the shutter before the second tray is completely housed.

3. The stacker device according to claim 1, wherein the second tray is detachably placed on a second tray base that is movable in the front-rear direction.

4. The stacker device according to claim 3, wherein the second tray base moved outside the stacker device is housed inside the stacker device in any one of states in which the second tray is placed on the second tray base, the second tray is not placed on the second tray base, and the second tray is placed on the second tray base in a lowered state when the second tray base has an elevating function.

5. The stacker device according to claim 3, wherein the hardware processor determines the height position of the shutter based on a position of the second tray base in the front-rear direction and on whether the second tray is placed on the second tray base.

6. The stacker device according to claim 1, further comprising:

a first switch that opens when the shutter is half-opened to an extent that the sheets stacked on the second tray are dischargeable outside the stacker device;

a second switch that opens when the second tray is housed inside the stacker device; and a third switch that closes when the shutter is fully closed, wherein the hardware processor executes the power shutoff according to a combination of opening/closing states of the first switch, the second switch, and the third switch without software control.

7. The stacker device according to claim 6, wherein the second switch and the third switch are connected in parallel, and the first switch is connected in series to the second switch and the third switch.

8. An image forming system comprising:

the stacker device according to claim 1; and an image forming apparatus that is provided on a front stage of the stacker device and forms images on the sheets, wherein the image forming apparatus supplies the sheets on which the images are formed to the discharger.

* * * * *